US006786020B2

(12) United States Patent
Poldmaa

(10) Patent No.: US 6,786,020 B2
(45) Date of Patent: Sep. 7, 2004

(54) ANCHOR FOR SAFETY ROPE

(76) Inventor: Arvo Poldmaa, 16 Moola Street, Hawks Nest, NSW 2324 (AU)

( * ) Notice: Subject to any disclaimer, the term of this patent is extended or adjusted under 35 U.S.C. 154(b) by 0 days.

(21) Appl. No.: 09/800,018

(22) Filed: Mar. 5, 2001

(65) Prior Publication Data

US 2001/0025464 A1 Oct. 4, 2001

Related U.S. Application Data

(63) Continuation of application No. PCT/AU98/00968, filed on Nov. 20, 1998.

(30) Foreign Application Priority Data

Sep. 3, 1998 (AU) ..... PP5682/98

(51) Int. Cl.[7] ..... E04C 5/00

(52) U.S. Cl. ..... 52/704; 411/361; 182/45; 52/698

(58) Field of Search ..... 52/698, 703, 704, 52/706, DIG. 12, 24, 57; 248/499, 500, 508, 558; 182/45, 3; 119/786, 787, 788, 789, 790; 403/78, 79, 73, 65; 411/427, 335, 8, 360, 361, 280–282, 537.2

(56) References Cited

U.S. PATENT DOCUMENTS

| | | | | | |
|---|---|---|---|---|---|
| 198,559 | A | * | 12/1877 | Bear | 119/786 |
| 217,004 | A | * | 7/1879 | Elmer | 119/786 |
| 498,351 | A | * | 5/1893 | Kasper | 119/786 |
| 1,378,482 | A | * | 5/1921 | Morgan | 119/786 |
| 4,136,596 | A | * | 1/1979 | Davis, Jr. | 411/360 |
| 4,531,613 | A | * | 7/1985 | Keigher | 182/206 |
| 4,601,623 | A | * | 7/1986 | Wallace | 411/336 |
| 5,011,106 | A | | 4/1991 | Cody | |
| 5,033,924 | A | * | 7/1991 | Cosenza | 411/282 |
| 5,143,171 | A | * | 9/1992 | Glynn et al. | 182/3 |
| 5,346,036 | A | * | 9/1994 | Arisman et al. | 182/3 |
| 5,785,007 | A | * | 7/1998 | Sauber et al. | 119/771 |
| 5,862,880 | A | * | 1/1999 | Nelson et al. | 182/45 |
| 5,878,534 | A | * | 3/1999 | Gleave | 52/27 |
| 6,016,889 | A | * | 1/2000 | Pearcy et al. | 182/3 |
| 6,668,509 | B1 | * | 12/2003 | Krebs | 52/698 |
| 2003/0152442 | A1 | * | 8/2003 | Curley et al. | 411/427 |

FOREIGN PATENT DOCUMENTS

| | | | |
|---|---|---|---|
| DE | 296 03 414 | * | 7/1996 |
| GB | 2 071 196 | A | 9/1981 |
| GB | 2 102 858 | A | 2/1983 |
| GB | 2 251 020 | A | 6/1992 |
| GB | 2 283 526 | A | 5/1995 |
| GB | 2 291 100 | A | 1/1996 |

* cited by examiner

*Primary Examiner*—Janet M. Wilkens
(74) *Attorney, Agent, or Firm*—Akin Gump Strauss Haver & Feld LLP

(57) ABSTRACT

The anchor device includes a ring mounted to a first end of a rod or tube for receiving the end of a safety rope, a mounting for securing the anchor device to a building element, and a locking nut for engaging a threaded portion of the rod or tube at a second end of the rod or tube, where the locking nut includes a non-threaded sleeve which extends around a portion of the rod or tube and which deforms when a load applied to the ring exceeds a predetermined value.

10 Claims, 8 Drawing Sheets

ANCHOR FOR SAFETY ROPE

CROSS-REFERENCE TO RELATED APPLICATION

This application is a continuation of International Application No. PCT/AU98/00968 filed Nov. 20, 1998, the disclosure of which is incorporated herein by reference.

TECHNICAL FIELD

This invention relates to safety harness systems and more particularly to devices for securing a safety rope to a building.

BACKGROUND ART

At present there are available safety harnesses and ropes which are intended to be secured to a structure so that if the wearer of the safety harness falls, their fall will be halted by the safety rope. However the integrity of the entire system relies on the rope being secured to an anchor point which can take the loading applied by a falling person. Such a load may be of the order of 22,000 N (equivalent to the weight of about 2.2 tonnes).

Most buildings or buildings under construction do not have any suitable anchor points, which may lead to a false sense of security if a safety harness is worn and attached to an inappropriate anchor point, or workers not wearing safety harnesses.

A further problem is that the building structure and in particular the roof structure is covered once Fe building is complete, and so it is not possible to attach a safety rope to the buildings structure once finished.

DISCLOSURE OF THE INVENTION

In an attempt to overcome some of the disadvantages of the prior art, the invention in one broad form provides an anchor device for a safety rope, the anchor device including:

receiving means for receiving a safety rope; and securing means for securing the receiving means to a building's structure.

The receiving means may be a closed ring or a ring with a movable section or an incomplete ring or similar.

Preferably the anchor device includes a deformable portion which deform under a load.

Preferably the receiving means is spaced from the securing means.

Preferably the receiving means is mounted on a rod or tube. The rod or tube preferably plastically deforms when subject to a predetermined load.

Preferably the rod or tube has a tapered section with the smaller cross-section nearer to the receiving means than the larger cross-section.

Preferably the device includes a mounting for attachment to a building and the mounting has more than one location to receive the securing means.

Preferably the device includes a ring mounted on one end of solid rod which increases in diameter away from the ring. The free end of the rod is preferably of constant diameter and is threaded to screw into a suitable threaded hole.

The hole into which the rod screws into may be mounted on a separate mounting which in turn in secured to the building structure or the rod may crew into a threaded hole on the building structure itself. The mounting may be such that the rod passes through the structure and sandwiches the structure between the rod and the mounting.

The device preferably includes an auxiliary locking nut and the rod is threaded so that when fully inserted a portion of the threaded section remains exposed and the locking nut is secured on the rod on this exposed portion to bear tightly against the mounting or structure.

Preferably the locking nut deforms under a predetermined load applied to the receiving means.

Preferably the length of the rod is such that when secured to a roof truss, the rod may extend through any roof cladding so that the receiving means extends above the roof cladding.

The invention also includes within its scope a beam or truss or similar having means for receiving the anchor device.

The means may be one or more apertures or slots through which the securing means passes to engage a fixing means. The fixing means may be a nut or dip which engages the securing means of the anchor device. If a clip is utilised, preferably it engages the beam or truss to be retained thereon in the absence of the anchor device.

Alternatively, the means for receiving may be one or more apertures or recesses in which the securing means engages. In one form, these may be threaded bores into which a threaded portion of the securing means engages with. Alternatively, the aperture may be unthreaded with a retaining mechanism, such as a spring loaded ball or tooth, to engage part of the securing means when inserted into the aperture.

In a preferred form, the beam is provided with a series of threaded apertures into which a threaded rod of the anchor device is screwed.

BRIEF DESCRIPTION OF THE DRAWINGS

The invention will be better understood from the following non-limiting description of preferred embodiments of the invention and the drawings in which.

Figure 1:
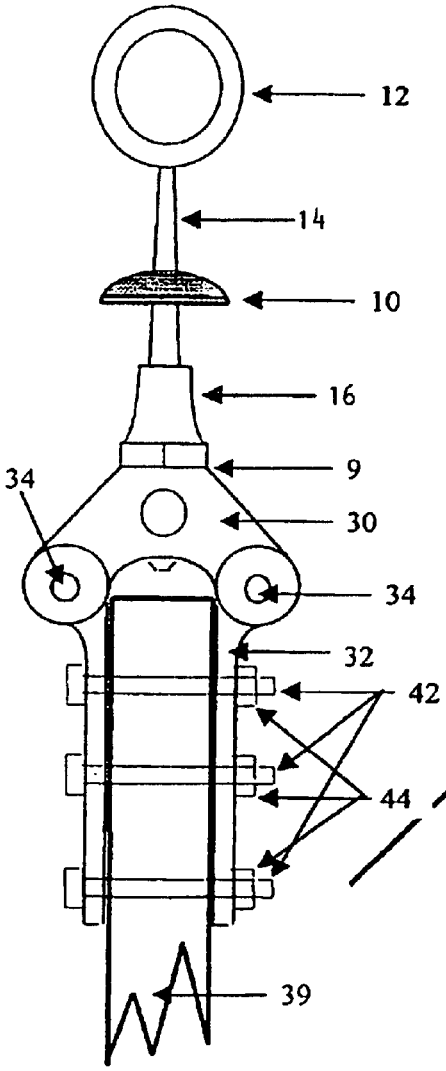
FIG. 1 is an end view of a first embodiment of the invention in sit.

The mounting 18 comprises a central receiving block 30 and two side wings 32, which are pivotally mounted on the block 30 by pins 34. Each of the wings 32 is provided with a series of holes 36 through which bolts or screws my pass.

The block 30 is provided with three receiving bores 38*a*, 38*b*, 38*c* which are threaded and sized to receive the threaded portion of rod 14. The central bore 38*a* is perpendicular to rods 34 whilst bores 38*b* and 38*c* are parallel to rods 34. If desired the bores 38*b* and 38*c* may be one bore extending through the block 30. The top surface 40 and side surfaces 42 are planer and perpendicular to their respective bore.

Referring to FIG. 1, in this mounting configuration the rod 14 is screwed into bore 38*a* and the side wings 34 pivoted to lie on either side of a roof truss 39. Bolts 42 are passed through bores 36 and corresponding holes in the roof truss and secured with nuts 44 to secure the mounting to the roof truss 39.

Figure 4:
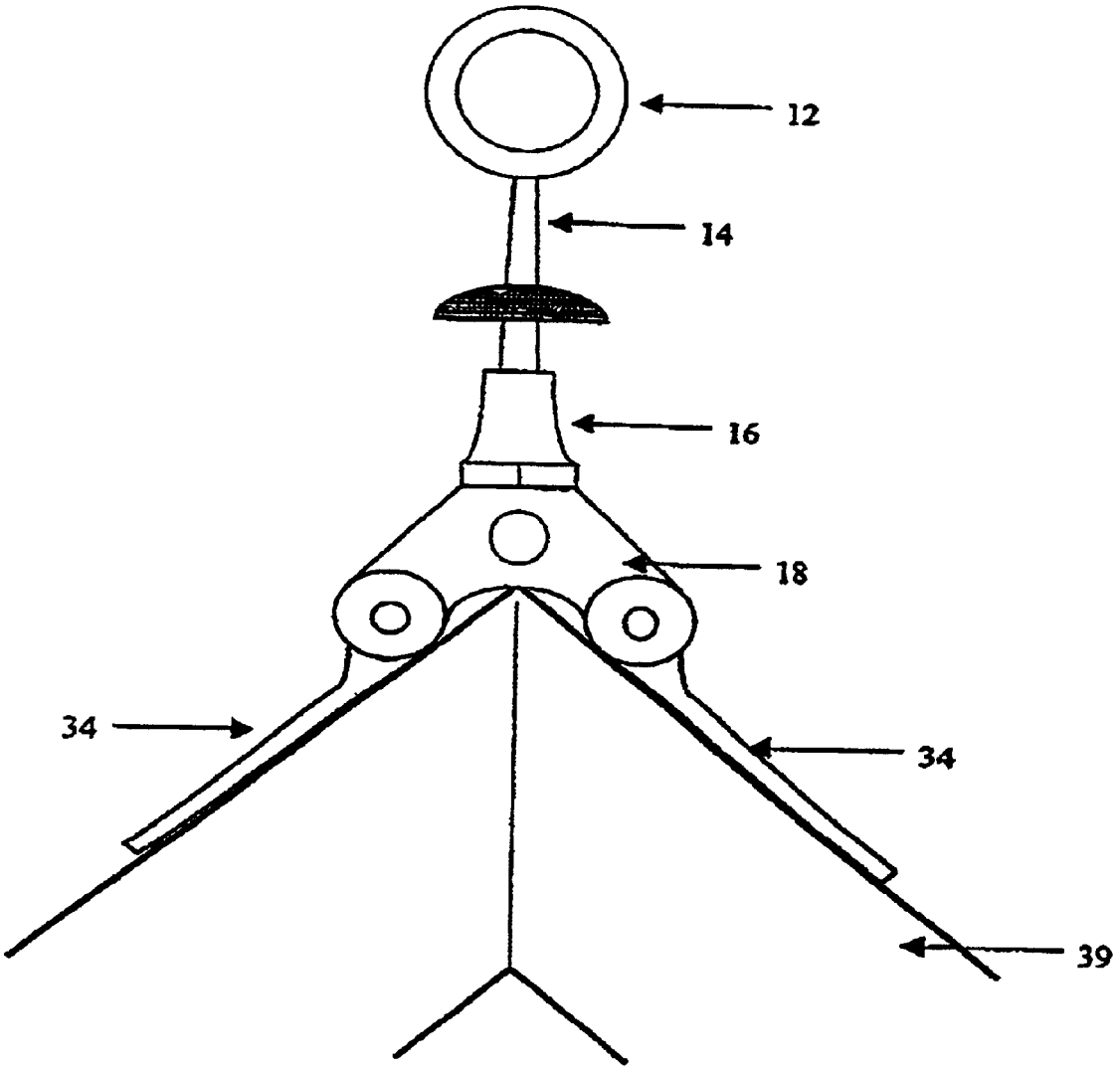
FIG. 4 is a side view of the FIG. 1 embodiment mounted on the apex of a roof structure.

Referring to FIG. 4, the device has been rotated by 90° and the wings 34 now lie on the top surface of the roof truss 39. Wood screws may be screwed through the bores 32 into the truss to secure the device instead of bolts.

Figure 5:
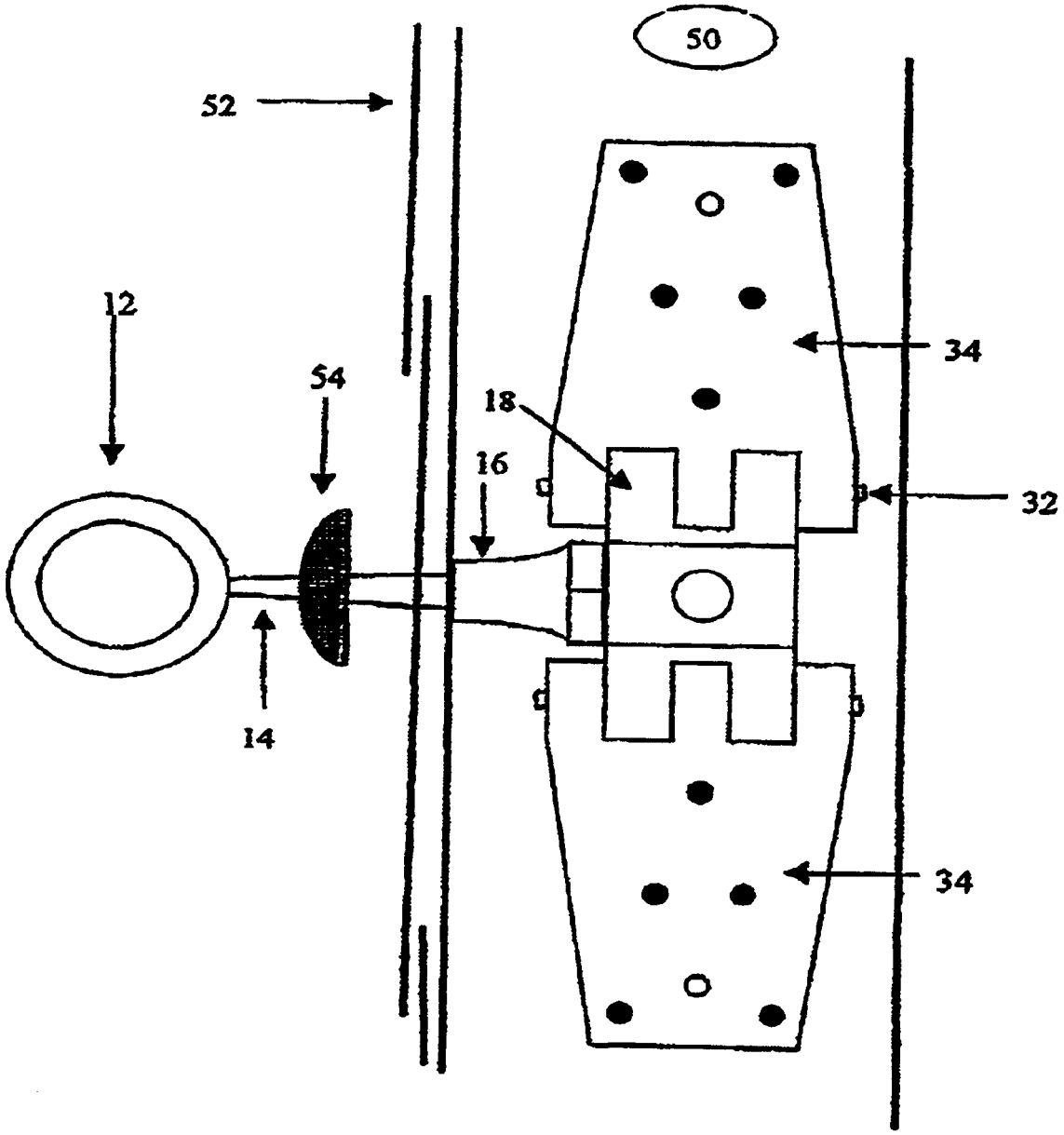
FIG. 5 is a side view of the FIG. 1 device mounted on a horizontal beam.

Referring to FIG. 5, the rod 14 is screwed into the side aperture 38*c* and the mounting is positioned on a vertical side fan of a longitudinally extending beam 50. Again, wood screws (not shown) may be used to secure the device to the beam 50. Obviously, the device in this configuration may be attached to a horizontal surface.

Figure 2:
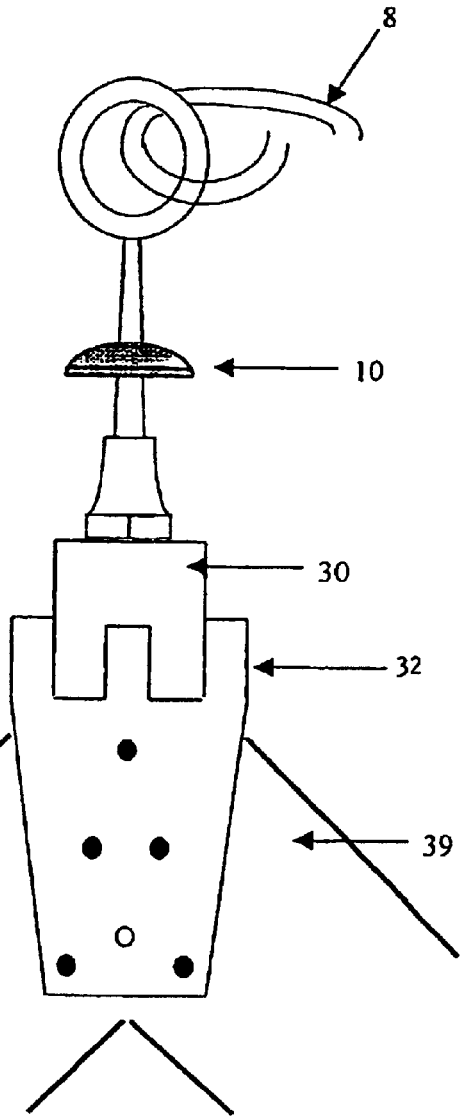
FIG. 2 is a side view of the FIG. 1 embodiment in su.
Figure 3:
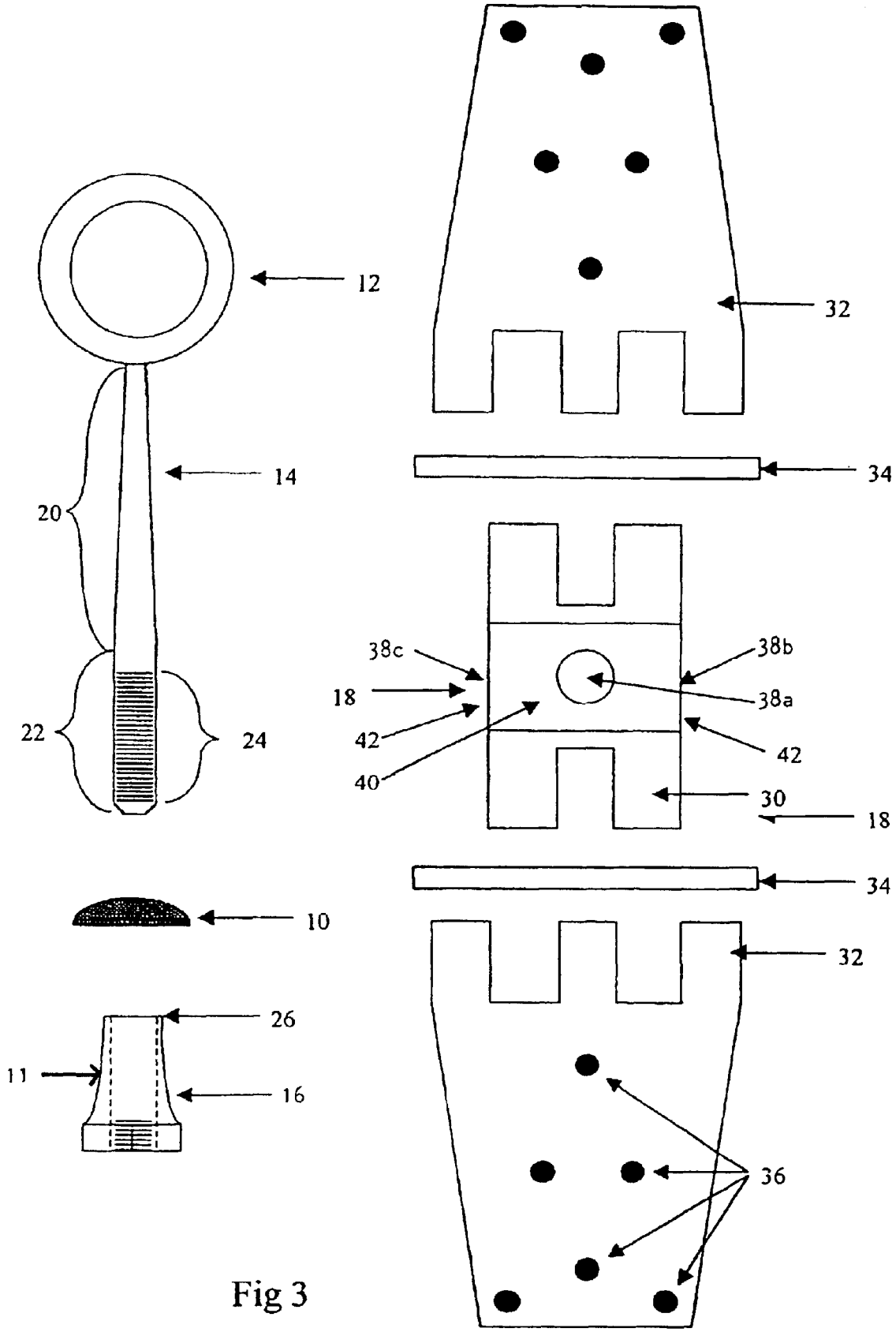
FIG. 3 is an exploded view of the FIG. 1 embodiment.

As can be seen in FIG. 5 the rod 14 may extend through an aperture in a roof cladding 52 so that the ring 12 is exposed even after the roof cladding has been attached. A weather seal 54 is provided to prevent ingress of water through the aperture. The same applies to the configuration of FIGS. 1, 2 and 4, in that a roof cladding may be placed on the roof and the ring left exposed. When adding the roof cladding 52, a hole is drilled, the rod 14 removed from mounting 18, passed through the hole and then reattached to the mounting 18.

Figure 7:
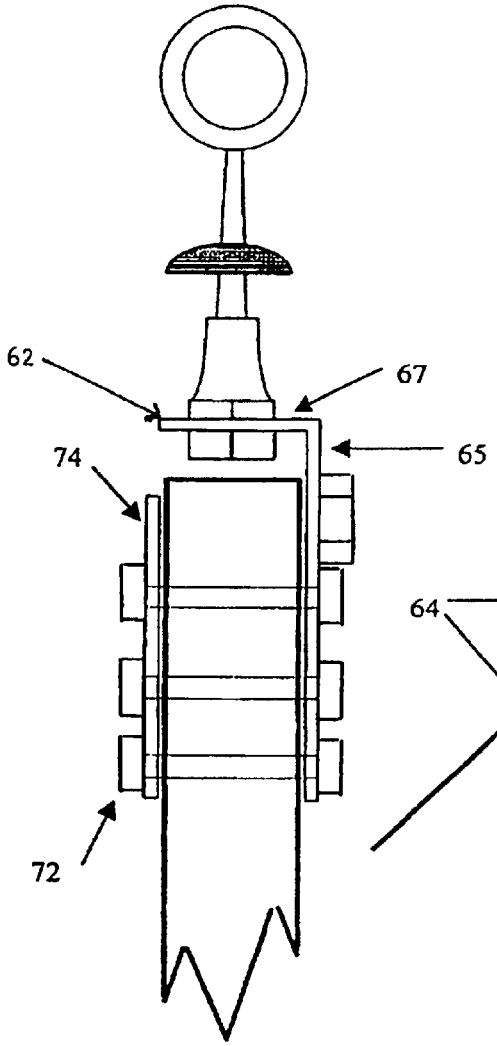
FIG. 7 is an end view of the FIG. 6 embodiment.
Figure 6:
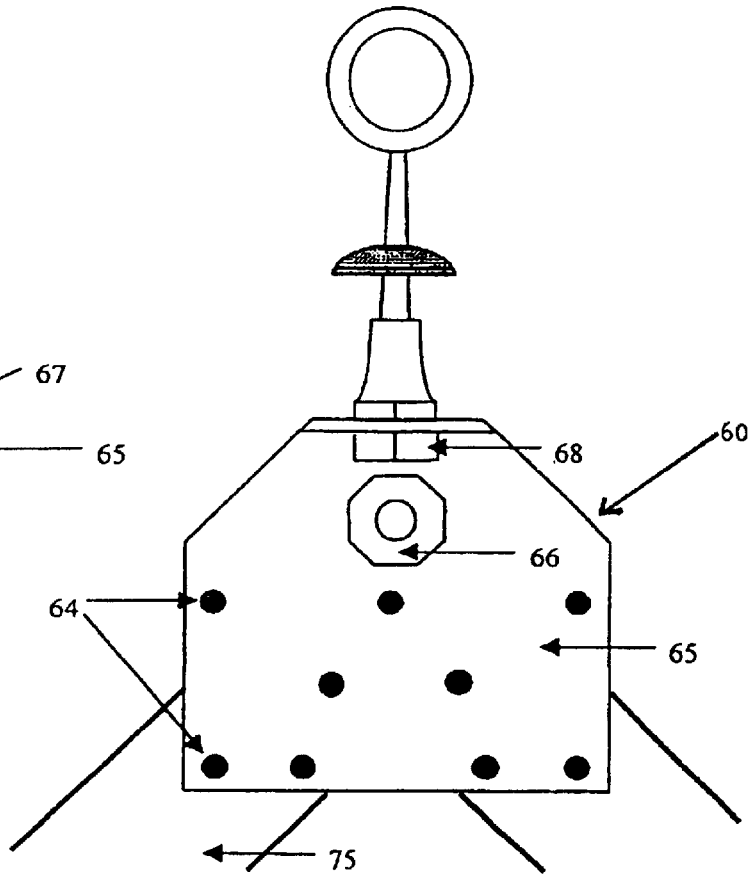
FIG. 6 is a side view of a second embodiment of the invention with a different mounting.

FIG. 6 and FIG. 7 show an embodiment with a different mounting 60. The ring 12, rod 14 and locking ring are unchanged.

The mounting includes an inversed L-shaped plate 62 provided with apertures 64 in arm 65 and two threaded mounting points 66, 68 for receiving the rod 14 either parallel or perpendicular to arm 65. These mounting points 66 may be a nut welded to arm 65 or arm 67.

The mounting 60 may be attached to a roof truss 70 with bolts 72, as in FIG. 7 or with wood screws if bob are used, preferably a pressure plate 74 is used on the other side of the truss 70.

Figure 8:
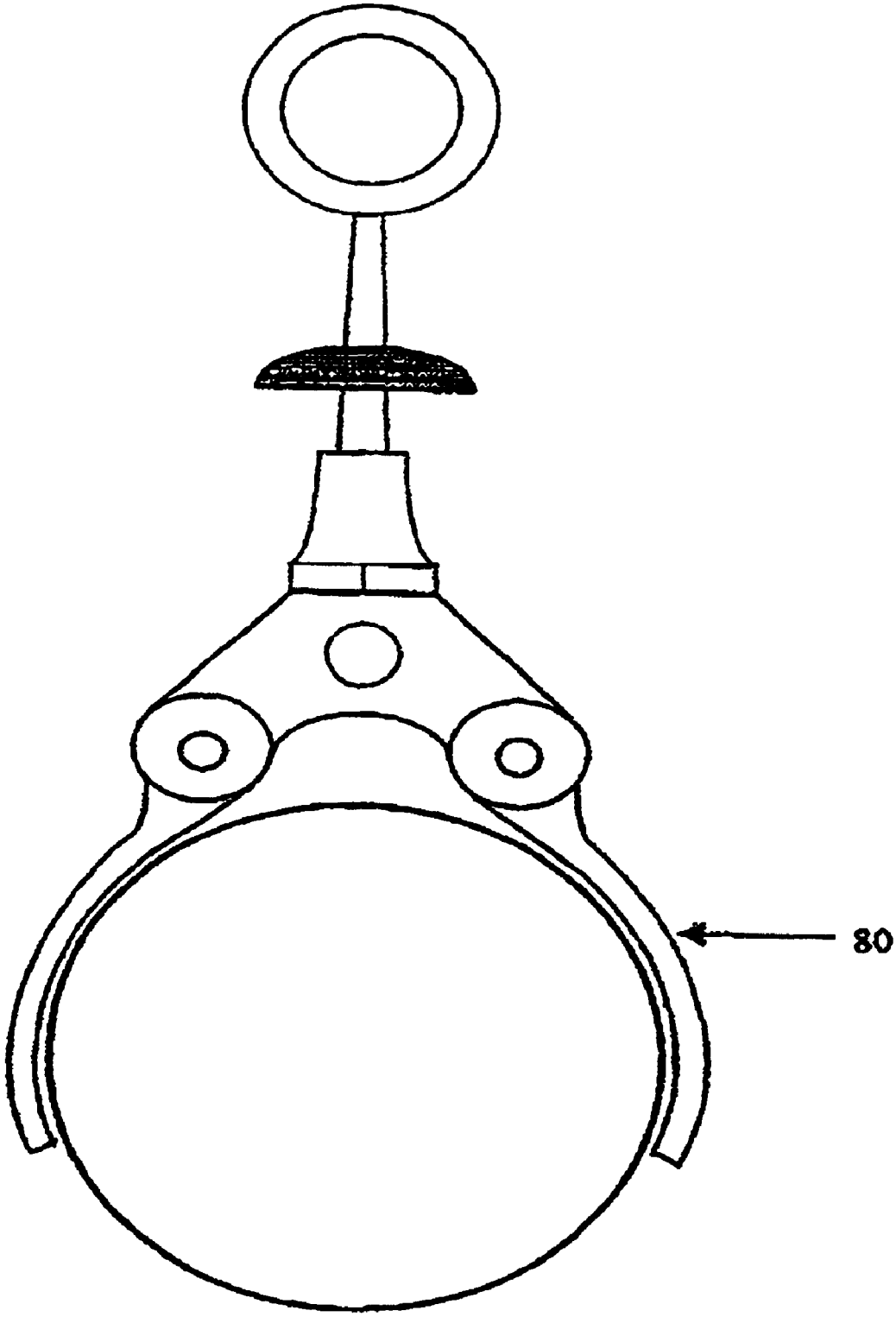
FIG. 8 is an end view of a third embodiment of the invention.

FIG. 8 shows an embodiment in which wings 80 are curved to enable mounting on a tube or rod of circular cross-section. All other parts are unchanged. The curvature of wings 80 is chosen to match that of the rod or tube and different wings 80 may be used for different sized tubes or rods.

Figure 9:
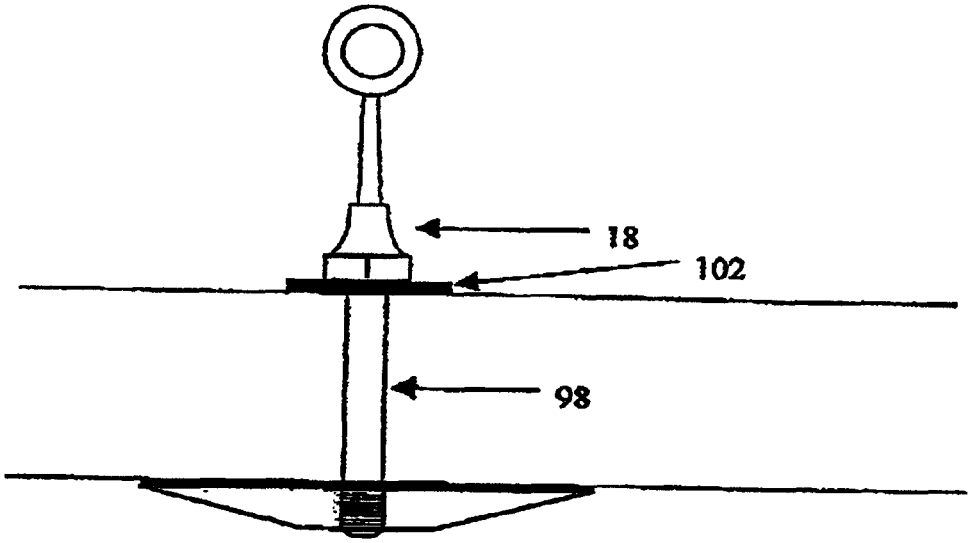
FIG. 9 is a side view of a fourth embodiment.
Figure 10:
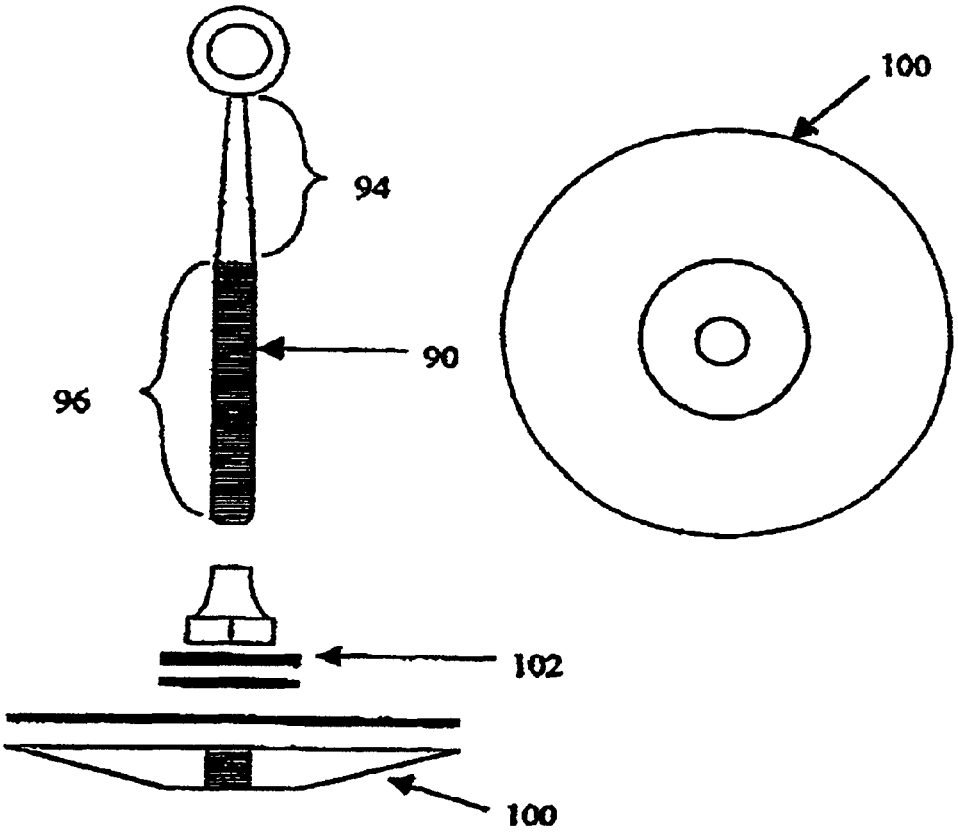
FIG. 10 is an exploded view of the FIG. 9 embodiment

FIGS. 9 and 10 show a further variation of the device in which an extended rod 90 is intended to be directly mounted on a roof truss or beam 92 or similar.

The tapered portion 94 of a rod 90 is the same size as for the earlier embodiments but the threaded portion 96 is much longer. This portion 96 may be as long as necessary so as to extend through a bore hole 98 in the beam 92. A threaded retaining disc/pressure plate 100 is provided into which Fe free end of the rod 92 is screwed. A washer 102 is also preferably sandwiched been the lock nut 18 and the beam 92 so as to spread any load transmitted through the lock nut 18. The device of FIGS. 9 and 10 may also be attached to a wall or a roof structure of sufficient strength.

Figures 11, 12, 13, 14:
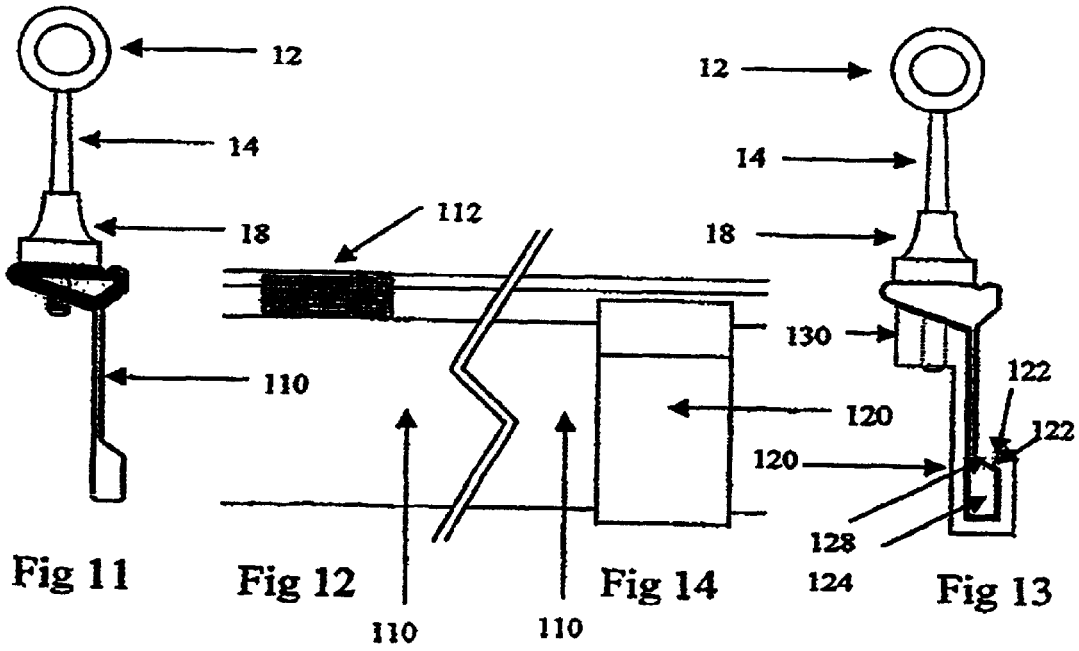
FIG. 11 shows a fifth embodiment of the invention.
FIG. 12 shows a cross-section of the FIG. 11 embodiment.
FIG. 13 shows a sixth embodiment.
FIG. 14 shows a side view of the FIG. 13 embodiment

FIGS. 11 and 12 show a truss or beam 110 adapted to directly receive the threaded rod 14 into a threaded aperture 12. The rod 14 may be screwed directly into the aperture and locked in place with the lock nut 18. The threaded aperture may be formed directly in the beam 110 or it may be a threaded insert. The shape of the beam is not important and other shapes may be used. Whilst FIG. 11 shows the threaded rod 14 extending downwards from the aperture 112, this is not essential.

FIGS. 13 and 14 show a retaining dip 120 for attachment to the beam 110 of FIG. 12. The dip has a retaining groove 122 which is sized to receive the lower portion 124 of beam 110. Preferably the groove has an extension 126 which engages the surface 128 to retain the dip 120 on the beam 110.

The upper part of the dip 120 has a threaded aperture 130 sized to receive the threaded end of the rod 14, which passes through an oversize and unthreaded bore or slot in the beam 110.

Figure 15:
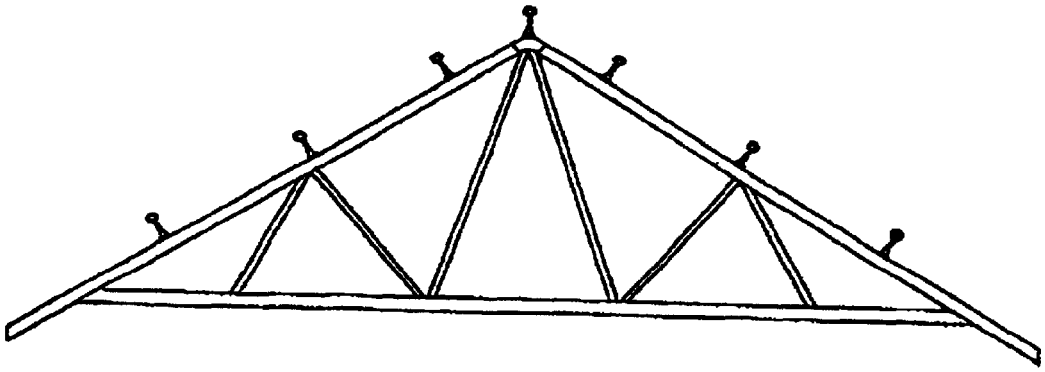
FIG. 15 shows a side view of a roof truss incorporating the inventive concept, Referring to FIGS. 1 to 5, the anchoring device 10 comprises a ring 12, a rod 14, a lock nut 16 and a mounting 18. The ring 12 is secured to one end of the rod 14. The ring 12 and rod 14 may be formed integrally or may be separate pieces welded together. The mounting 18 is preferably made of aluminum. Preferably the ring and the rod are made of stainless steel. The rod 14 is tapered at 20 and increases in diameter from about 8 mm adjacent the ring 12 to about 13.7 mm about 90 mm from the ring. The taper may increase to a larger diameter, if desired. Preferably, the angle of the taper remains the same. The rod 14 then has a constant diameter portion 22 to its free end. A portion 22 of the constant diameter section is threaded. The constant diameter portion 22 is preferably about 60 mm in length with the threaded portion 24 about 40 mm in length. The lock nut 16 has an internal bore 26 threaded so as to receive the threaded portion 24 of the rod 14. The bore 26 may be threaded over only part of its length.

FIG. 15 shows a roof truss made according to the beams of FIGS. 12 or 14 with the anchor devices of FIGS. 11 and 12 and/or FIGS. 13 and 14 attached.

The operation of the anchor devices of all the embodiments is basically the same and will be described with reference to the FIGS. 1 to 5 device.

When a safety rope 8 is attached to both the ring 12 and a user, it is normally un-tensioned and the of rope is greater than the distance between the ring 12 and the user. If the user loses their grip and falls. Initially they are unrestrained until the rope 8 is puffed tight at this point the person may have a considerable velocity which must be stopped by applying a force to that body via the rope 8 and the anchor device. The rope 8 may stretch a little or have sewn sections which unravel to reduce the impact but despite this the acceleration and hence forces created in the rope and on the anchoring device 10 are high.

The forces tend to be applied perpendicular to the axis of Me rod 14 and if the bending forces are below the plastic limit, the rod 14 deforms elastically. If the bending forces are above the elastic limit the rod 14 commences to deform plastically. Because the rod 14 is tapered, the weakest part of the rod 14 is the section adjacent the ring 12. Thus this portion bends. However in bending toward the direction of the applied force the bending moment on that section is reduced and so, as the force increases the entire rod progressively bends, from the ring 12 to the constant diameter section 22.

If the forces are still hight the rod 14 starts to bend at the junction 9 of the lock nut with the surface 40. As the rod bends about junction 9, the cone shaped sheath 11 of the lock nut 18 will be bent out of shape by the bending rod.

Finally, if the impact is sufficiently high the tapered section 20 of the rod 14 will be straightened by the applied force so as to extend in the direction of the force.

It will be appreciated that by providing a rod 14 and lock nut 18 we progressively bend, the energy of the fall may be dissipated by working of more metal. Whilst a rod 14 of constant cross-section is within the scope of the invention, it will be appreciated that a constant cross-section rod will bend only at the point furthest from the applied load—at the junction with the mounting surface 40. Bending along the rod will not occur and so a larger size rod would be required.

It will be appreciated that, as shown by the embodiments, that the specific type of mounting portion of the device is not essential to the working of the invention and that the device may be mounted directly on a roof beam or truss or via a mounting bracket. Obviously the mounting bracket or similar must not fail under a load less than will be applied by a falling person.

It will be appreciated that many modifications and variations may be made to the embodiments described herein by those skilled in the art without departing from the spirit or scope of the invention.

INDUSTRIAL APPLICABILITY

It will be appreciated by one skilled in the art that the anchor device of the present invention represents a significant advance in the art and is capable of providing increased safety compared to the prior art

What is claimed is:

1. An anchor device for a safety rope, the anchor device including:

a rod or tube;

receiving means for receiving an end of a safety rope mounted on or integral with a first end portion of the rod or tube;

securing means for securing the device directly or indirectly to a building element, said securing means including a second end portion located opposite the first end portion of the rod or tube, at least a portion of the second end portion being threaded; and at least one locking nut adapted to engage the threaded portion of the second end portion, the at least one locking nut including a non-threaded sleeve which extends around a portion of the rod or tube, the non-threaded sleeve deforming when a load applied to the receiving means exceeds a predetermined value.

2. The device of claim 1 further including mounting means to which the securing means is attached.

3. The device of claim 2 wherein the mounting means includes two or more locations to receive the securing means.

4. The device of claim 2 wherein the mounting means is adapted to be attached to said building element.

5. The device of claim 1 wherein said building element has an aperture and said securing means passes through or engages with the aperture.

6. The device of claim 5, further including a mounting means, wherein the building element is sandwiched between the mounting means and the at least part of the securing means.

7. A building element including at least one mounting location for receiving the anchor device of claim 1.

8. The building element of claim 7 wherein the at least one location is a threaded bore.

9. The building element of claim 8 wherein the at least one location is a bore sized to allow the securing means to pass therethrough to engage the mounting means and sandwich the building element between the mounting means and at least part of the securing means.

10. The combination of the anchor device as claimed in claim 1 and a building element including at least one mounting location for receiving the anchor device.

* * * * *